US005081569A

United States Patent [19]

Quiogue et al.

[11] Patent Number: 5,081,569

[45] Date of Patent: Jan. 14, 1992

[54] LUMINAIRE WITH CHANGEABLE ACCENT LIGHTING

[75] Inventors: Honesto D. Quiogue, Florence, Ky.; Thomas E. Kuhlmann, Cincinnati, Ohio

[73] Assignee: Spaulding Lighting, Inc., Cincinnati, Ohio

[21] Appl. No.: 403,207

[22] Filed: Sep. 5, 1989

[51] Int. Cl.[5] ..... F21V 13/14

[52] U.S. Cl. ..... 362/328; 362/293; 362/308; 362/329; 362/375; 362/806

[58] Field of Search ..... 362/293, 307, 308, 328, 362/329, 362, 375, 806, 299

[56] References Cited

U.S. PATENT DOCUMENTS

| | | | |
|---|---|---|---|
| 1,818,120 | 8/1931 | Doane | 362/299 |
| 1,824,894 | 9/1931 | Hopkin | 362/293 |
| 3,705,302 | 12/1972 | Judge et al. | 362/308 X |
| 3,832,539 | 8/1974 | Oram | 362/293 |
| 4,393,440 | 7/1983 | Yperman | 362/329 X |
| 4,450,513 | 5/1984 | Guggemos | 362/299 |
| 4,651,257 | 3/1987 | Gehly | 362/293 |

OTHER PUBLICATIONS

"Saturn" luminaire advertisement, *Architectural Lighting*, May 1989, p. 65.

*Primary Examiner*—Stephen F. Husar

*Attorney, Agent, or Firm*—Seidel, Gonda, Lavorgna & Monaco

[57] ABSTRACT

A luminaire has an accent light which is colored by a translucent filter. The luminaire includes a light source, a reflector having a first opening and a second opening holdidng the translucent filter, and a housing. The reflector encloses the light source, and a portion of the light passes through the translucent filter in the reflector. The housing generally encloses the reflector and has at least one opening in the intended shape of the accent light.

10 Claims, 2 Drawing Sheets

LUMINAIRE WITH CHANGEABLE ACCENT LIGHTING

FIELD OF THE INVENTION

This invention relates to lighting fixtures, or luminaires, having a main source of light and a colored "accent strip". The accent strip gives a distinct appearance to the luminaire when the luminaire is viewed in a dimly-lit area.

BACKGROUND OF THE INVENTION

In most architectural situations, luminaires are intended not only to provide sources of light but to have a distinct appearance in themselves. In the case of outdoor luminaires, very often the luminaire itself cannot be seen in the dark when the light is turned on. In order to give a distinct appearance to outdoor luminaires when they are viewed at night, it is common to design the luminaire with an accent light. An accent light is a secondary light, usually of a unique color or shape, which provides a distinctive appearance to the luminaire apart from light emitted from the luminaire for illumination purposes.

In typical architectural projects it is not uncommon to require large quantities of luminaires. Consequently, the concerns of cost-saving in mass production are acute in the manufacture of luminaires. It would be useful not only to minimize production costs within a single architectural project, but also to create luminaires whose design can be easily varied for different projects, thus enabling a large number of designs to be created using a small number of mass-produced parts.

One popular style of accent light is in the form of a narrow strip of colored light around the perimeter of the luminaire. Most of the light from the light source in the luminaire is used for illumination of the surrounding area, but the bright accent light will give the luminaire a distinct and pleasing appearance in a generally dark situation where the luminaire itself cannot be seen, such as in a dark parking lot. However, one problem with the narrow-strip design is that translucent colored filters for providing the color to the accent light are difficult to manufacture in the shape of the perimeter of a luminaire. The narrow-strip colored filters may also be difficult to install in the luminaires, particularly in the field. If it is decided to change the color of the accent light, changing the narrow-strip colored filters is a difficult and expensive task.

It is an object of the present invention to provide a luminaire having a narrow-strip colored accent light, which can be any of a variety of colors, which can be inexpensively manufactured and installed, and where the color of the accent light can be changed easily.

It is another object of the invention to provide a luminaire having an accent light wherein the accent light is illuminated by the same light source that produces the illumination from the luminaire.

Other objects will appear hereinafter.

SUMMARY OF THE INVENTION

The invention is a luminaire having a single light source, a reflector, and a housing. The reflector generally encloses the light source, and has a first opening through which most of the light from the light source is emitted. The reflector has a second, smaller opening that holds a translucent filter. A portion of the light from the light source passes through this colored filter.

The housing encloses the reflector and has two openings. The first opening generally corresponds to the first opening of the reflector, through which most of the light from the light source passes. The second opening in the housing is in the shape of the accent light. The reflector and the housing are so arranged that a portion of the light from the light source passes through the translucent filter in the reflector, reflects inside the housing, and is emitted through the accent light.

In a preferred embodiment of the invention the translucent filter held by the reflector is an inexpensive disk of colored glass which can be changed or replaced easily with spring clamps. With the present invention there is no necessity of having an expensive narrow-band colored filter placed along the perimeter of the luminaire.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
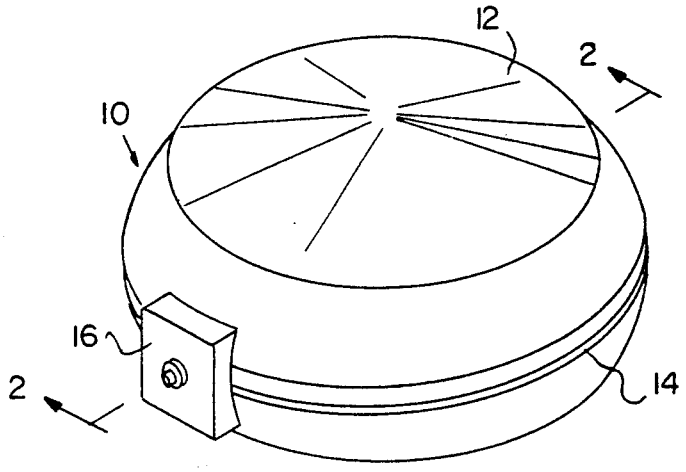
FIG. 1 is a perspective view of the exterior of a luminaire according to the present invention.

FIG. 1 shows the exterior of luminaire 10, viewed generally from above. The general external shape of luminaire 10 is defined by the shape of housing 12. Within the scope of the claims, housing 12 may be any of an infinite variety of shapes. In the preferred embodiment, housing 12 is bisected by a narrow accent strip 14. The accent strip 14 may, but need not, encircle the luminaire 10 at its widest point. When the light source within luminaire 10 is switched on, most of the light is emitted through the bottom of the luminaire 10 (not shown in FIG. 1) and a portion of the light is emitted through accent strip 14. The light emitted through accent strip 14 may be colored by using a colored filter as described below. Mounting means 16 are provided on one side of luminaire 10 allow the luminaire 10 to be mounted on a vertical surface, such as a wall or post.

Figure 3:
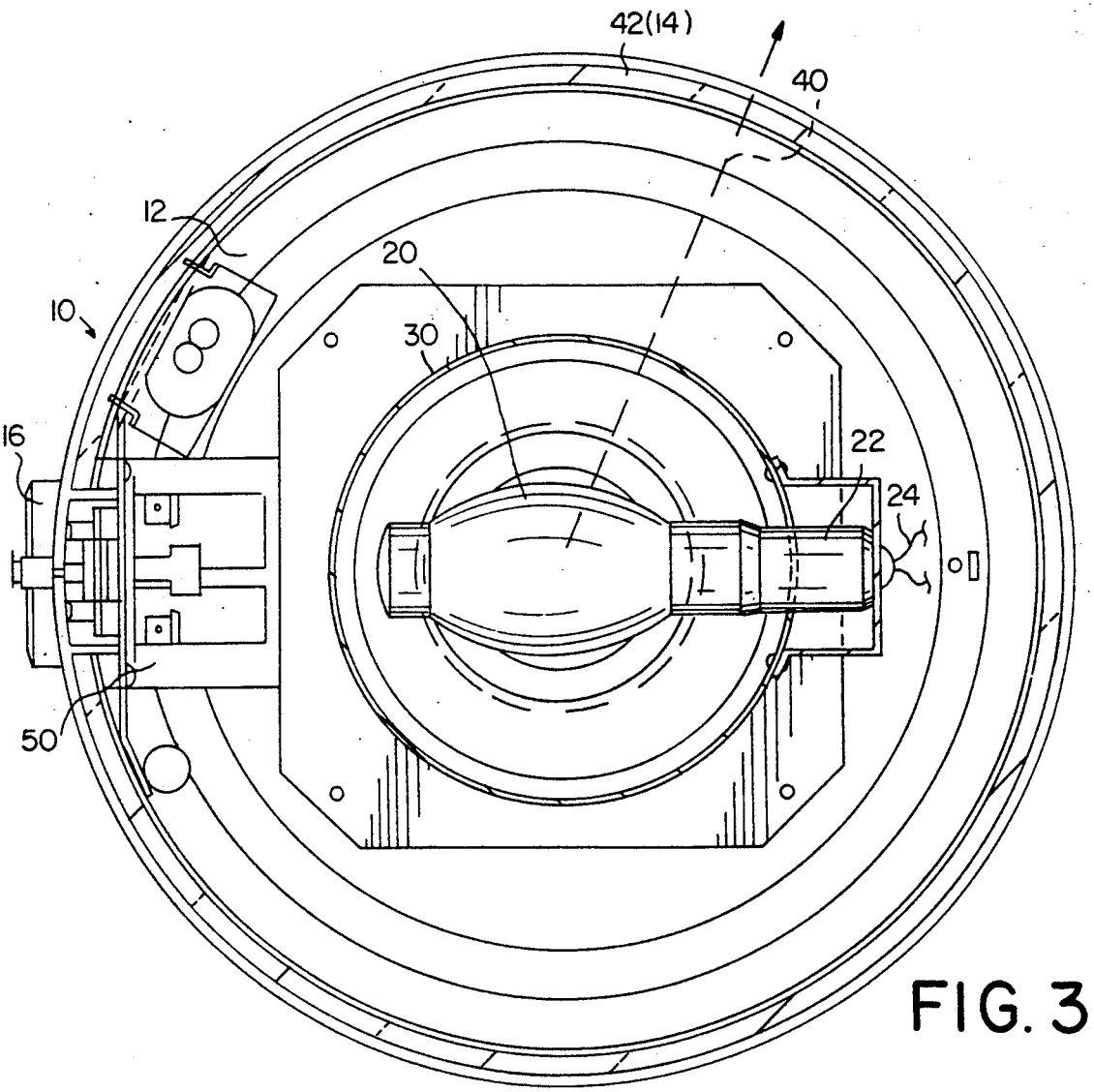
FIG. 3 is a cross-sectional view of the luminaire as seen through line 3—3 of FIG. 2.
Figure 2:
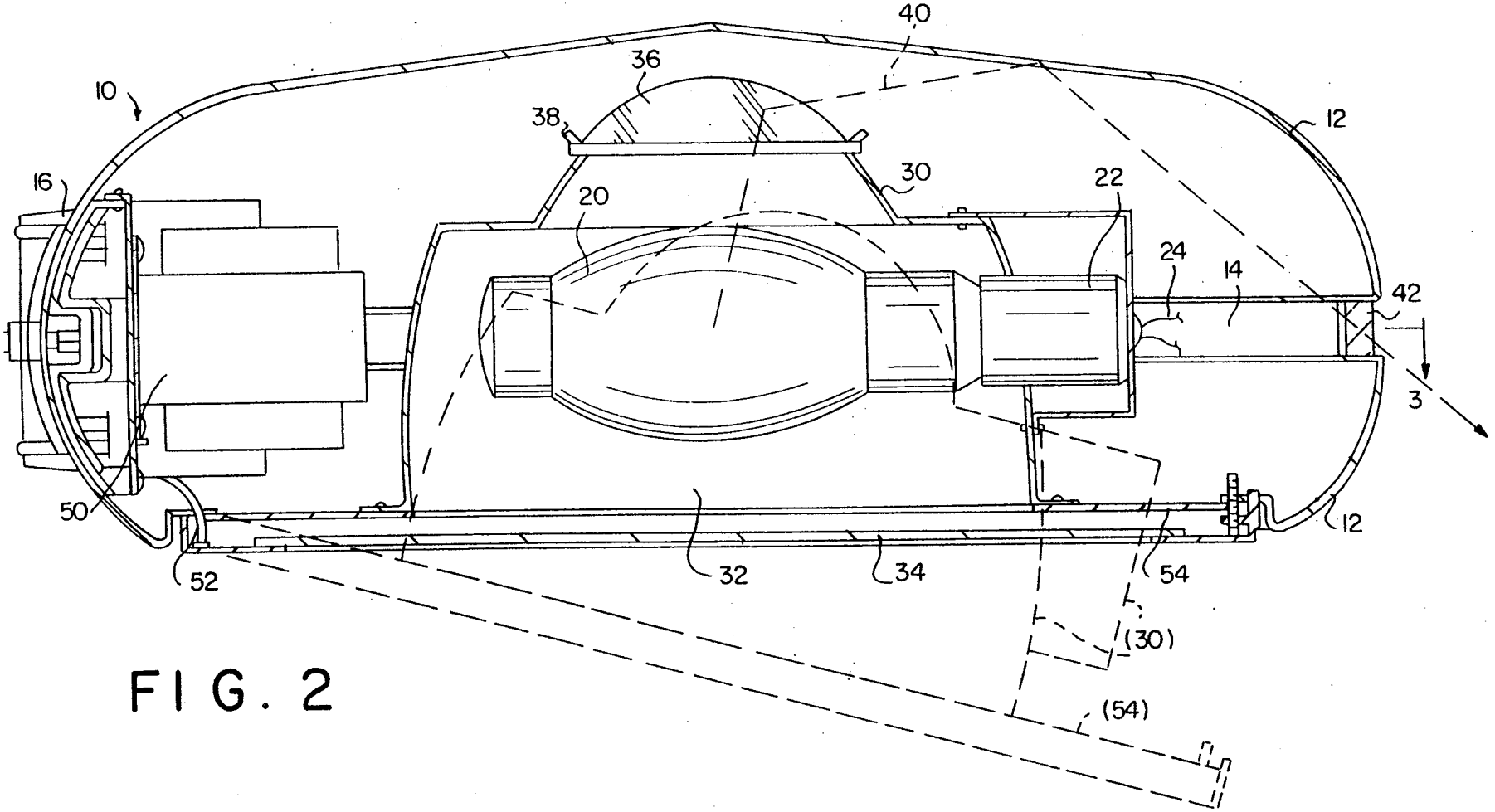
FIG. 2 is a cross-sectional view of the luminaire as seen through line 2—2 of FIG. 1.

FIG. 2 is a cross-sectional view through line 2—2 of FIG. 1, and FIG. 3 is a cross-sectional view through line 3—3 of FIG. 2. In those figures, at the center of luminaire 10 is illustrated the light source 20, which may be of any design. In the preferred embodiment, light source 20 is installed in socket 22, which is in turn connected by wires 24 to a source of electricity.

Substantially enclosing light source 20 is reflector 30. Reflector 30 is designed so that most of the light from light source 20 will be reflected downward through opening 32. Opening 32 may be covered by a transparent window 34, so as to protect the light source 20.

On the top portion of reflector 30 is a colored filter 36. Colored filter 36 is a piece of translucent material which may, but need not, have refractive properties. Colored filter 36 may be of a lens shape, as shown in FIG. 2, or be simply a flat piece of glass or plastic. Colored filter 36 is held in place by means of inexpensive spring clips 38, which enable the installer to insert or replace colored filters 36 without tools.

Dotted line 40 shows the path of a typical beam of light emitted from the light source 20 which illuminates accent strip 14. The beam begins at the light source 20 and passes upward through colored filter 36. At colored filter 36 the light is refracted, or bent, because of the curvature of the glass, and given a distinctive color from the colored glass 36 as it enters the space between the reflector 30 and the inside of the housing 12. Thus, all the light between reflector 30 and the inside of housing 12 will be of one color, colored by the colored filter 36. The light represented by dotted line 40 will be reflected within the housing 12 (which may, but need not, have a reflective surface on its interior) and is finally emitted through window lens 42. Window lens 42 is a transparent glass or plastic window which defines the accent strip 14.

As shown in FIG. 3, window lens 42 is a transparent, ring-shaped lens which encircles the luminaire 10 in the area of the accent strip 14. Window lens 42 in itself provides no coloration to the light passing therethrough. All of the color for the accent light 14 is provided by the colored filter 36.

The present invention provides several advantages over previous designs. The disk-shaped colored filter 36 is easier to manufacture and install than the window lens 42. To provide for or change the color of the accent strip 14, the installer need only install or replace the colored filter 36, which is easily removed and replaced by means of the spring clips 38. In contrast, to install or replace a colored window lens 42, the entire housing 12 would have to be dismantled. With the present invention, no matter what the intended color of the accent strip 14, a transparent window lens 42 is used. Use of the colored filter 36 to provide color is less expensive both to manufacture and install.

Also included within housing 12 may be a mounting structure 50 which is firmly attached to mounting means 16, thereby providing stability when the luminaire 10 is mounted on a vertical surface. Mounting structure 50 may also incorporate ancillary electrical equipment, such as would be used in conjunction with a fluorescent lamp. It is advisable to have any heavy electrical equipment mounted close to the mounting means 16, so that the luminaire 10, when it is mounted, will not bend or sag over time.

Another feature of the present invention is hinge 52 upon which is connected reflector frame 54. Reflector means 30, with light source 20 and colored filter 36, is rigidly attached to reflector frame 54. Because reflector frame 54 is mounted on hinge 52, the entire assembly of reflector 30, light source 20, and colored filter 36 may be swung down from the housing 12 for maintenance purposes, as shown by the phantom lines representing reflector (30) and reflector frame (54) in FIG. 2.

When reflector frame 54 is swung down, an installer or maintenance worker will have access to colored filter 36. If it is decided to change the colors of the accent strips (for example, at the holiday season) one colored filter 36 is removed simply by pushing back the spring clips 38 and replacing it with a colored filter 36 of a different color. Also, the protective cover 34 may be removable for gaining access for replacing the light source 20 or cleaning out the interior of the reflector 30.

An advantage of using a colored filter 36 capable of refracting light is that, by choosing the correct refraction in relation to the window lens 42, the light passing through the colored filter 36 may be substantially focused to maximize light output through the window lens 42. The amount of refraction necessary for colored filter 36 will vary by the relative shapes and positions of the window lens 42, and the shape of the interior surface of housing 12.

Although the preferred embodiment shown herein is used to illuminate an accent strip which bisects a substantially cylindrical luminaire, it is intended that the invention recited in the claims may be embodied in luminaires of a variety of shapes, such as rectangular and for accent strips of any configuration on the luminaire, not just a narrow band bisecting the body of the luminaire.

The present invention may be embodied in other specific forms without departing from the spirit or essential attributes thereof and, accordingly, reference should be made to the appended claims, rather than to the foregoing specification, as indicating the scope of the invention.

What is claimed:

1. A luminaire comprising:

a light source;

reflector means generally enclosing the light source, the reflector means having a first opening and a second opening, the second opening having translucent filter means disposed therein;

housing means generally enclosing the reflector means, the housing means having a first opening generally in alignment with the first opening of the reflector means, and at least one additional opening;

the reflector means and housing means being arranged for permitting a portion of the light emitted from the light source to pass through the translucent filter means and through the at least one additional opening of the housing means.

2. A luminaire as in claim 1, wherein the reflector means includes means for removably attaching the translucent filter means in the second opening of the reflector means.

3. A luminaire as in claim 1, wherein the translucent filter means is adapted to refract light.

4. A luminaire as in claim 1, wherein the housing means is reflective on at least a portion of its interior surface and the reflector means and housing means are so arranged for permitting light passing from the light source through the translucent filter means to be reflected within the housing means and pass through said at least one additional opening of the housing means.

5. A luminaire comprising:

a light source;

reflector means generally enclosing the light source and having a first opening and a second opening;

a translucent filter means disposed within the second opening of the reflector means;

means for removably attaching the translucent filter means in the second opening of the reflector means; and housing means generally enclosing the reflector means and having a first opening and a second opening, the first opening generally in alignment with the first opening of the reflector means, and the second opening generally shaped to define a strip around the perimeter of the housing means;

the light source, reflector means and housing means being arranged for permitting a portion of the light emitted from the light source to pass through the translucent filter, be reflected within the housing means, and pass through the second opening of the housing means.

6. A luminaire as in claim 5, further comprising access means movably attached to the outer rim of the first opening of the reflector means and releasably attached to the outer rim, for providing access to the space between the reflector means and the housing means.

7. A luminaire as in claim 6, wherein the access means is attached to the housing means by a hinge means.

8. A luminaire as in claim 5, wherein the translucent filter means is adapted to refract light.

9. A luminaire as in claim 5, further comprising means for attaching the luminaire to a vertical surface.

10. A luminaire comprising:

a light source;

reflector means generally enclosing the light source and having a first opening and a second opening;

a translucent filter means, adapted to refract light, disposed within the second opening of the reflector means;

means for removably attaching the translucent filter means in the second opening of the reflector means;

housing means generally enclosing the reflector means and having a first opening and a second opening, the first opening generally in alignment with the first opening of the reflector means, and the second opening generally shaped to define a strip around the perimeter of the housing means; and door means comprising a hinge attached to the outer rim of the first opening of the housing means and the outer rim of the first opening of the reflector means for providing access to the space between the reflector means and the housing means;

the light source, reflector means and housing means being arranged to permit a portion of the light emitted from the light source to pass through the translucent filter, be reflected within the housing means, and pass through the second opening of the housing means.

* * * * *